US006375389B1

(12) United States Patent
Melegari

(10) Patent No.: US 6,375,389 B1
(45) Date of Patent: Apr. 23, 2002

(54) METHOD FOR FITTING DRAINAGE DEVICES INTO THE SOIL, AND DRAINAGE PIPES FOR CARRYING OUT SAID METHOD

(76) Inventor: Cesare Melegari, Via Boschi, 25, 43015 Noceto (PR) (IT)

( * ) Notice: Subject to any disclaimer, the term of this patent is extended or adjusted under 35 U.S.C. 154(b) by 0 days.

(21) Appl. No.: 09/631,968

(22) Filed: Aug. 3, 2000

(51) Int. Cl.[7] ..... E02B 11/00
(52) U.S. Cl. ..... 405/45; 405/43; 405/50
(58) Field of Search ..... 405/41, 43, 44, 405/45, 50, 253, 184.4, 184.5

(56) References Cited

U.S. PATENT DOCUMENTS 1,688,356 A * 10/1928 Romney ..... 405/45
2,659,208 A * 11/1953 Jourdain ..... 405/45
3,103,789 A * 9/1963 McDuff et al. ..... 405/45
3,946,762 A * 3/1976 Green ..... 405/45
4,118,940 A * 10/1978 Beane ..... 405/45
4,622,138 A * 11/1986 Wager ..... 405/45
4,626,129 A * 12/1986 Kothmann et al. ..... 405/43
4,650,367 A * 3/1987 Dietzler ..... 405/43
4,904,112 A * 2/1990 McDonald ..... 405/45
5,141,360 A * 8/1992 Zeman ..... 405/43
5,152,634 A * 10/1992 Maso ..... 405/45
5,209,605 A * 5/1993 Cherrington ..... 405/43
5,263,791 A * 11/1993 Zeman ..... 405/43
5,332,160 A * 7/1994 Ruskin ..... 405/45
5,810,509 A * 9/1998 Nahlik, Jr. ..... 405/43

* cited by examiner

*Primary Examiner*—Thomas B. Will
*Assistant Examiner*—Alexandra K. Pechhold
(74) *Attorney, Agent, or Firm*—Young & Thompson

(57) ABSTRACT

A drainage device and method of inserting drainage devices in the ground characterized in that the ground is drilled in one or more places with a tubular drilling rod fitted with a bit and containing drainage slits in the side wall. When the required depth is reached, the drilling rod is left in the ground in order to act directly as a drainage pipe. A sheath of water-soluble material, designed to prevent debris from clogging the drainage slits during the drilling stage, is applied to the outer surface of the drilling rod.

8 Claims, 2 Drawing Sheets

METHOD FOR FITTING DRAINAGE DEVICES INTO THE SOIL, AND DRAINAGE PIPES FOR CARRYING OUT SAID METHOD

FIELD OF THE INVENTION

This invention relates to a method of inserting drainage equipment into the ground, in which the soil is drilled with drilling rods having slits distributed along the rod wall so that the said rods, which are left in the ground when the required depth has been reached, also act as drainage pipes. The invention also relates to devices for the implementation of the said method, consisting of drainage pipes which present a number of slits for water drainage, are fitted at the tip with a disposable bit, and are equipped with means designed to prevent clogging of the said slits during drilling, the said means being constituted by a protective sheath made of water-soluble material which dissolves on contact with the water present in the soil.

In accordance with a preferred form of embodiment, the drilling rods are constituted by two coaxial pipes, an outer pipe made of steel and an inner pipe made of plastic, particularly PVC.

The necessary resistance to stresses during drilling is therefore guaranteed by the outer steel pipe, while the long life of the device is ensured by the presence of the inner plastic pipe, which remains in pristine condition for many years.

BACKGROUND OF THE INVENTION

In accordance with the present state of the art, pipes made of plastic, particularly PVC, containing special slits and covered with a geotextile fabric, are used for soil drainage.

In order to lay these pipes, the soil is drilled with a bit which pulls a metal lining pipe with it as it advances.

When the required depth is reached, the drilling rods are removed, leaving the metal pipe in the ground, and the PVC drainage pipe is inserted inside it.

The outer metal pipe is then removed and the PVC pipe remains in the ground, at the required depth, thus allowing water drainage. As will be seen, this is a rather laborious method which requires time, skilled labour, and the use of expensive, sophisticated equipment for lengthy periods.

It would be desirable to have simpler, faster and cheaper equipment to achieve the same result, and this invention consequently proposes a method and the associated devices in which drilling is performed with rods containing slits which can therefore act directly as drainage pipes, the said rods being left in the ground when the required depth has been reached.

The rods in accordance with the invention are covered with an outer sheath made of water-soluble material, which prevents debris from clogging the drainage slits during excavation and dissolves in a few hours after the pipe comes into contact with the wet soil.

BRIEF DESCRIPTION OF THE DRAWINGS

This innovation will now be described in detail, by way of example but not of limitation, with special reference to the annexed figures, in which.

DETAILED DESCRIPTION OF THE PREFERRED EMBODIMENTS

Figure 2:
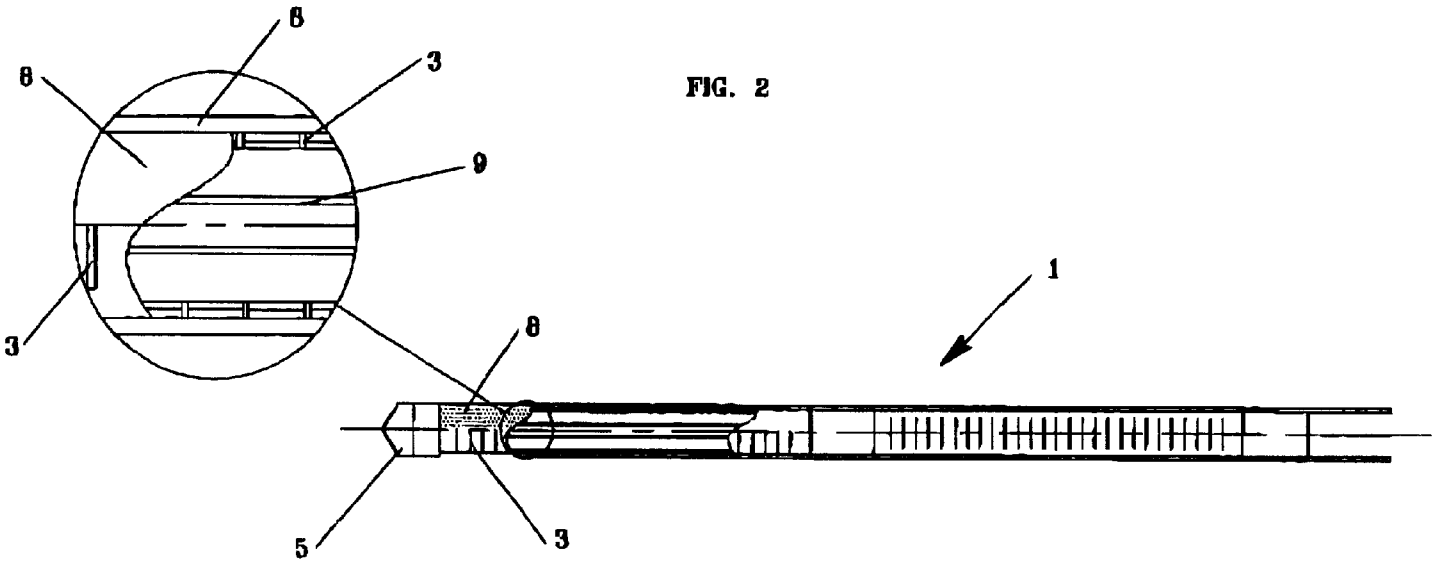
FIGS. 1 and 2 schematically illustrate two drainage pipes in accordance with the invention; the enlarged details in those figures show the front of the rods, partly in cross-section and partly in a side view
Figure 1:
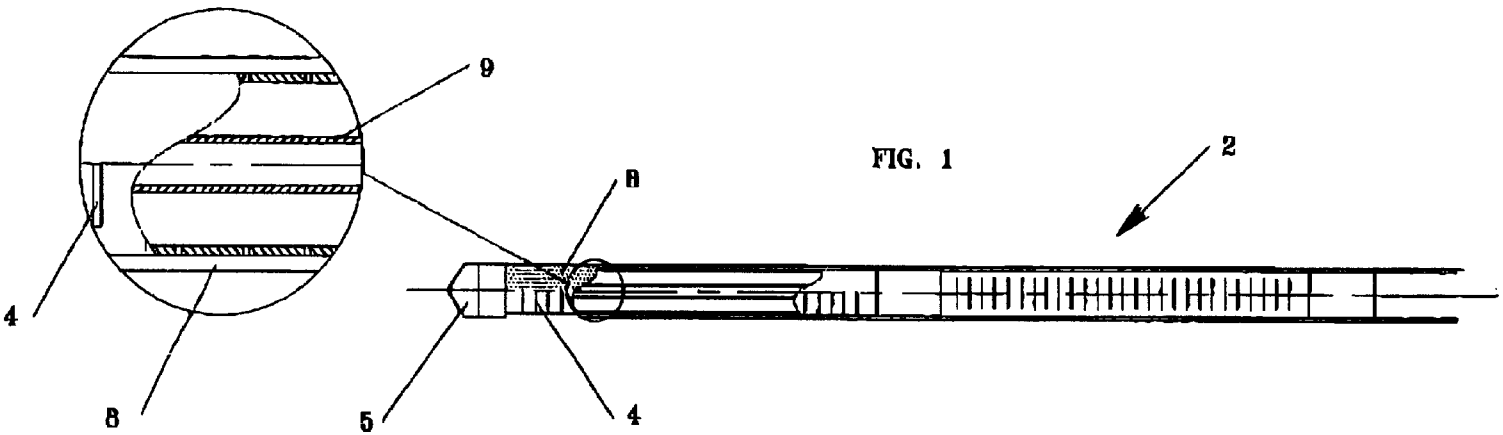

In accordance with the invention, for the purpose of soil drainage the ground is drilled in one or more places with rods 1 and 2 containing a set of slits 3 and 4, which allow the said rods to act as drainage pipes when they reach the required depth.

Each of these drilling rods is fitted at the front with a disposable bit 5, which presents a set of channels 10 for the passage of the water flow necessary during drilling, the said water being supplied through an inner tube 9 of smaller diameter.

Bit 5 presents a coupling, in particular a calyx coupling, for connection of inner tube 9 of small diameter, through which the water required for drilling is pumped under pressure.

According to a preferred form of embodiment, the rods are constituted by two coaxial pipes 6 and 7, namely a metal outer pipe sufficiently thick to be used as a drilling rod, and an inner pipe made of plastic, such as PVC, both of which pipes contain slits which allow water drainage.

The drilling rod is covered with an outer sheath 8 made of water-soluble plastic, which is designed to prevent the drainage slits from becoming clogged by debris during excavation and dissolves within a few hours after coming into contact with the moisture in the soil.

A suitable material for this purpose is the material known by the trademark Hydrolene, for example.

When the required depth has been reached, the inner pipe is removed, and the drilling rod, constituted by the steel and PVC pipes, remains positioned at the required depth.

The water in the soil dissolves water-soluble outer sheath 8 in a few hours, thus clearing slits 3 and 4 in the pipe walls.

In this case, the pipe must be made of a durable material such as stainless steel.

Figure 4:
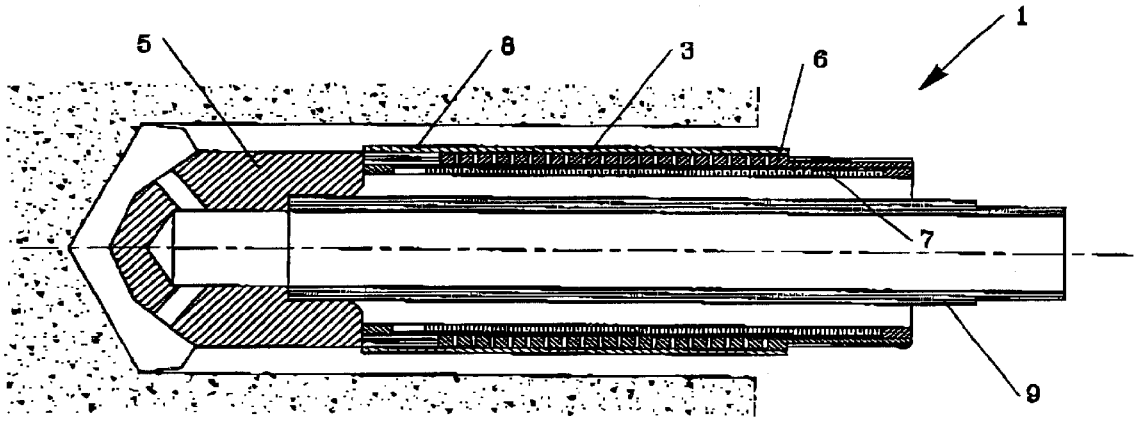
FIGS. 3 and 4 show a cross-section along the axis of the end part of the drainage pipes in accordance with the invention schematically illustrated in the preceding figures.

In the case of the drainage pipe shown in FIG. 4, the outer metal pipe serves to give the rod the necessary mechanical strength during the drilling stage. The inner PVC pipe serves to ensure long life over the years, even after the outer metal pipe deteriorates.

Figure 3:
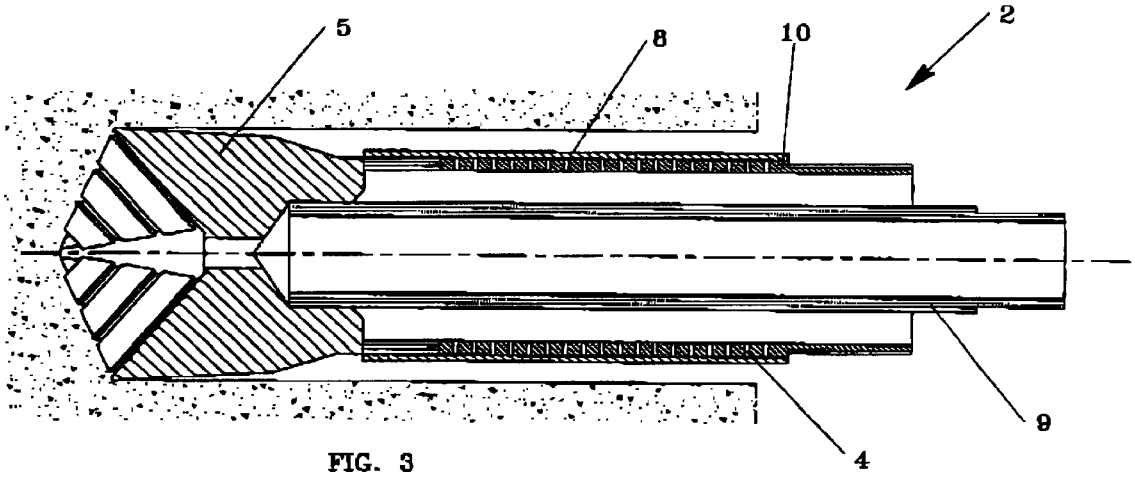

Drainage pipe 10, shown in FIG. 3, is made entirely of metal, without the inner PVC pipe.

In both forms of embodiment described, the drilling rod contains a set of water drainage slits in the side wall so that the rod itself can act as a drainage pipe after being driven into the ground.

The method and devices in accordance with the invention thus considerably simplify the manufacture of drainage devices, and make the operations of laying pipes in the ground much faster and easier.

What is claimed is:

1. Method of inserting drainage devices in the ground, characterised in that:

the ground is drilled in one or more places with a tubular drilling rod fitted with a bit and containing drainage slits in the side wall when the required depth is reached, the drilling rod is left in the ground in order to act directly as a drainage pipe, and applying a sheath made of water-soluble material, designed to prevent debris from clogging the drainage slit during the drilling stage, to the outer surface of the drilling rod.

2. Method as claimed in claim 1, characterised in that water under pressure is pumped through one or more tubes in the bit during drilling.

3. Method as claimed in claim 2, characterised in that the rod used for drilling comprises an outer metal layer sufficiently thick to guarantee necessary mechanical strength during drilling, and an inner PVC layer which ensures suitable durability of the drainage pipe.

4. Drainage device characterised in that it consists of at least one pipe with a drilling bit at one end and a plurality of slits in the side wall designed to allow water drainage when the at least one pipe is laid in the ground, said at least one pipe constitutes both a drilling rod and a drainage pipe, and said at least one pipe having an outer covering made of water-soluble material.

5. Drainage device as claimed in claim 4, characterised in that said at least one pipe comprises two coaxial layers, an outer metal layer designed to guarantee necessary mechanical strength during drilling, and an inner plastic layer designed to ensure necessary durability of the device.

6. Device as claimed in claim 5, in which the outer layer is steel and the inner layer is PVC.

7. Device as claimed in claim 4, characterised in that the drilling rod is fitted with a tube designed to introduce a given quantity of water into the soil under pressure close to the bit of the said drilling rod.

8. Drainage device characterised in that is consists of at least one pipe with a drilling bit at one end and a plurality of slits in the side wall designed to allow water drainage when the at least one pipe is laid in the ground, said at least one pipe constituting both a drilling rod and a drainage pipe, the drilling rod being fitted with a tube adapted to introduce a given quantity of water into the soil under pressure close to the bit of said drilling rod, said at least one pipe being made of stainless steel, with an outer sheath made of water-soluble material.

* * * * *